US007833058B2

(12) United States Patent
Zhang et al.

(10) Patent No.: US 7,833,058 B2
(45) Date of Patent: Nov. 16, 2010

(54) MICRO PLUG CONNECTOR

(75) Inventors: Shun-Hua Zhang, Hsin-Tien (TW); Sheng-Shun Chin, Hsin-Tien (TW); Jian Cheng, Hsin-Tien (TW); Min-Lung Chien, Hsin-Tien (TW); Feng Li, Hsin-Tien (TW)

(73) Assignee: Advanced Connectek Inc., Hsin-Tien (TW)

( * ) Notice: Subject to any disclaimer, the term of this patent is extended or adjusted under 35 U.S.C. 154(b) by 126 days.

(21) Appl. No.: 12/317,913

(22) Filed: Dec. 30, 2008

(65) Prior Publication Data

US 2010/0062642 A1 Mar. 11, 2010

(30) Foreign Application Priority Data

Sep. 8, 2008 (TW) ..... 97216233 U

(51) Int. Cl.
*H01R 9/03* (2006.01)

(52) U.S. Cl. ..... 439/607.41

(58) Field of Classification Search ..... 439/607.01, 439/607.41, 607.55, 660, 352, 353, 305, 439/79

See application file for complete search history.

(56) References Cited

U.S. PATENT DOCUMENTS 6,139,350 A * 10/2000 Mathesius ..... 439/357
6,840,806 B2 * 1/2005 Kodama ..... 439/607.24
7,128,588 B2 * 10/2006 Hu et al. ..... 439/159
7,625,236 B1 * 12/2009 Wu ..... 439/607.58
7,690,948 B2 * 4/2010 Lung ..... 439/607.27
7,695,304 B2 * 4/2010 Chiang et al. ..... 439/353
2006/0234530 A1 * 10/2006 Chung ..... 439/79
2008/0020058 A1 * 1/2008 Chen et al. ..... 424/502
2008/0045084 A1 * 2/2008 Chang ..... 439/607
2009/0280687 A1 * 11/2009 Liu et al. ..... 439/607.55
2009/0325417 A1 * 12/2009 Ko ..... 439/350

* cited by examiner

*Primary Examiner*—Alexander Gilman
(74) *Attorney, Agent, or Firm*—C. G. Mersereau; Nikolai & Mersereau, P.A.

(57) ABSTRACT

A micro plug connector has an insulative housing, a plurality of terminals, a pair of positioning hooks and a metal shell. The insulative housing has a base and a tongue protruding from the base. The terminals and positioning hooks are mounted through the base into the tongue. The metal shell covers the insulative housing and has a front cover and a rear cover. The front cover is mounted around the tongue and has a connecting plate protruding from the front cover and partially covering the bottom of the base. The rear cover formed on the front cover and covers the base and the connecting plate of the front cover. The front and rear covers double cover the insulative housing to strengthen the structures of the micro plug connector and prevent inadvertent disassembly or failure of the micro plug connector.

13 Claims, 9 Drawing Sheets

MICRO PLUG CONNECTOR

BACKGROUND OF THE INVENTION

1. Field of the Invention

The present invention relates to a connector, and more particularly to a micro plug connector such as a Micro Universal Serial Bus (Micro USB) plug connector that has an insulative housing and a metal shell firmly covering the insulative housing to improve the structural strength and durability of the micro plug connector.

2. Description of Related Art

Universal Serial Bus (USB) 2.0 protocol with the plug-and-play function is widely used applied to various electronic devices. Electronic devices such as desktops, flash drives, external hard drives, cellular phones and laptops usually have USB 2.0 connectors to implement the connection with other electronic devices.

Portable devices such as laptops and cellular phones are designed more and more compact to facilitate the storage and carrying thereof. Therefore, Micro-USB connectors are further developed and are more compact when compared to the USB 2.0 connectors so that the Micro-USB connectors may be easily assembled on the portable electronic devices.

However, the conventional Micro-USB plug connector has weak structure and the metal shell is not firmly mounted on the insulative housing of the plug connector. When the plug connector is connected to a cable, rotating the cable relative to the plug connector over 180 degrees would easily detach wires of the cable from terminals of the plug connector to cause failure of the signal transmission between the plug connector and the cable. Therefore, conventional Micro-USB plug connectors in the market are seldom qualified under the rotary test of the USB Implementers Forum (USB-IF). In other words, those conventional Micro-USB plug connectors are disconnected easily from the cables when rotated relative to the cables.

To overcome the shortcomings, the present invention provides a micro plug connector to mitigate or obviate the aforementioned problems.

SUMMARY OF THE INVENTION

The main objective of the invention is to provide a micro plug connector such as a Micro Universal Serial Bus (Micro USB) plug connector that has an insulative housing and a metal shell firmly covering the insulative housing to improve the structural strength and durability of the micro plug connector.

A micro plug connector in accordance with the present invention comprises an insulative housing, a plurality of terminals, a pair of positioning hooks and a metal shell. The insulative housing has a base and a tongue protruding from the base. The terminals and positioning hooks are mounted through the base into the tongue. The metal shell covers the insulative housing and has a front cover and a rear cover. The front cover is mounted around the tongue and has a connecting plate protruding from the front cover and partially covering the bottom of the base. The rear cover formed on the front cover and covers the base and the connecting plate of the front cover. The front and rear covers double cover the insulative housing to strengthen the structures of the micro plug connector and prevent inadvertent disassembly or failure of the micro plug connector.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
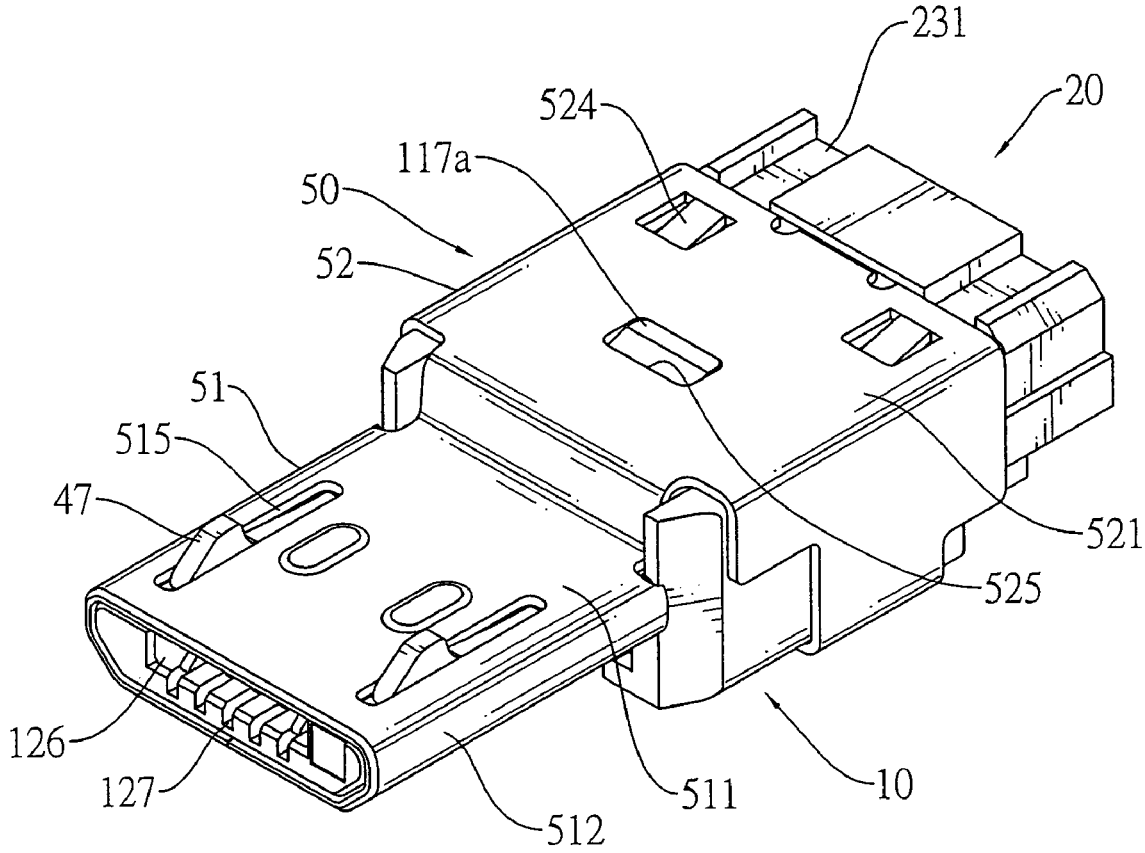
FIG. 1 is a front perspective view of a micro plug connector in accordance with the present invention.
Figure 2:
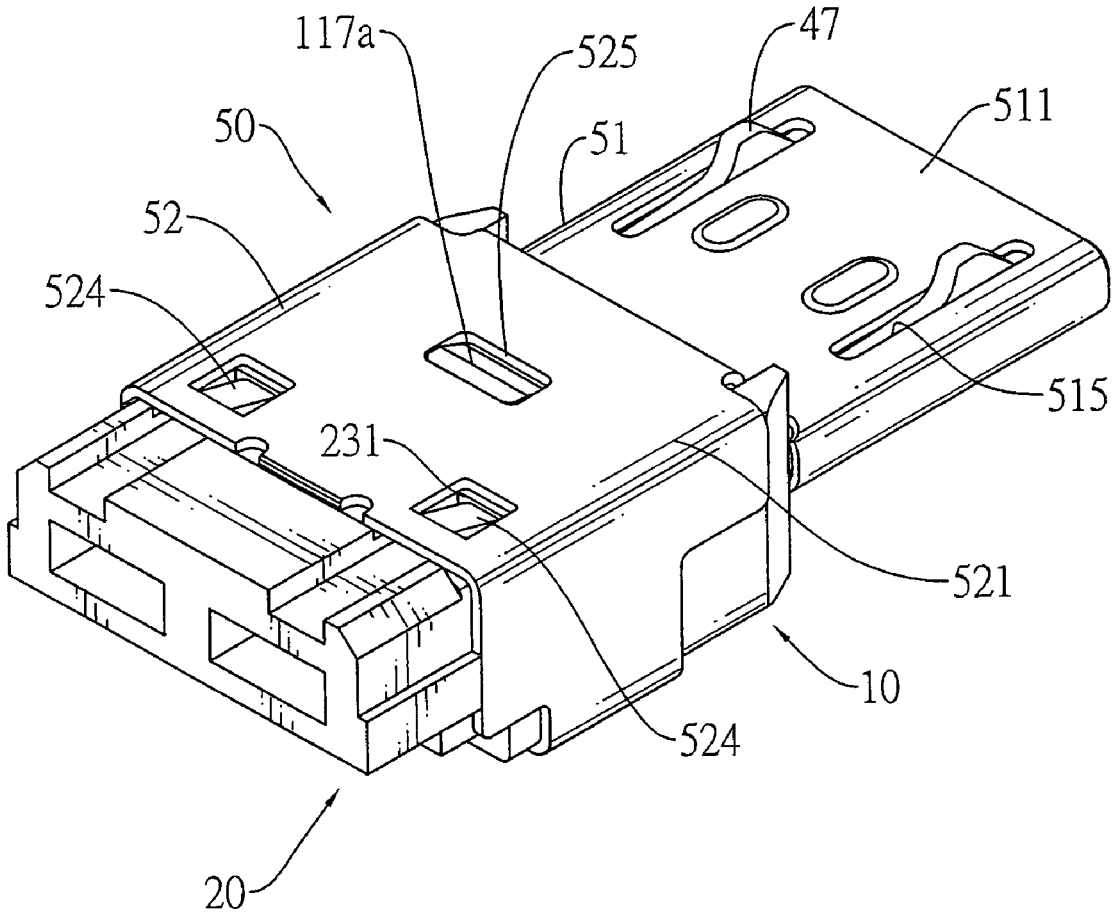
FIG. 2 is a rear perspective view of the micro plug connector in FIG. 1.
Figure 4:
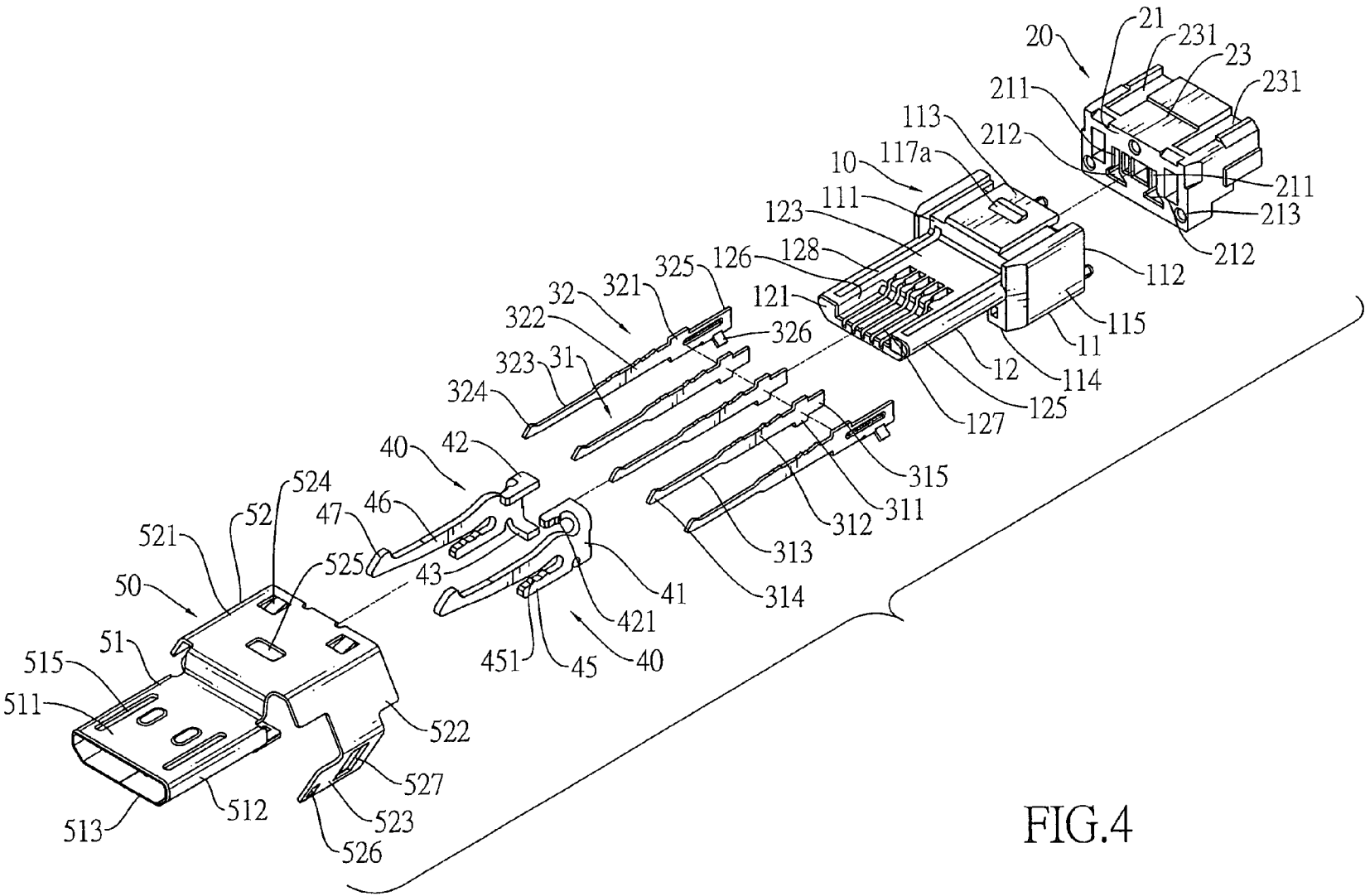
FIG. 4 is an exploded front perspective view of the micro plug connector in FIG. 1.

With reference to FIGS. 1, 2 and 4, a micro plug connector in accordance with the present invention may be a Micro Universal Serial Bus (Micro-USB) plug connector complying with the Micro-USB standard and comprises an insulative housing (10), a connection bracket (20), a plurality of terminals (31, 32), two positioning hooks (40) and a metal shell (50).

The insulative housing (10) has a base (11) and a tongue (12).

Figure 5:
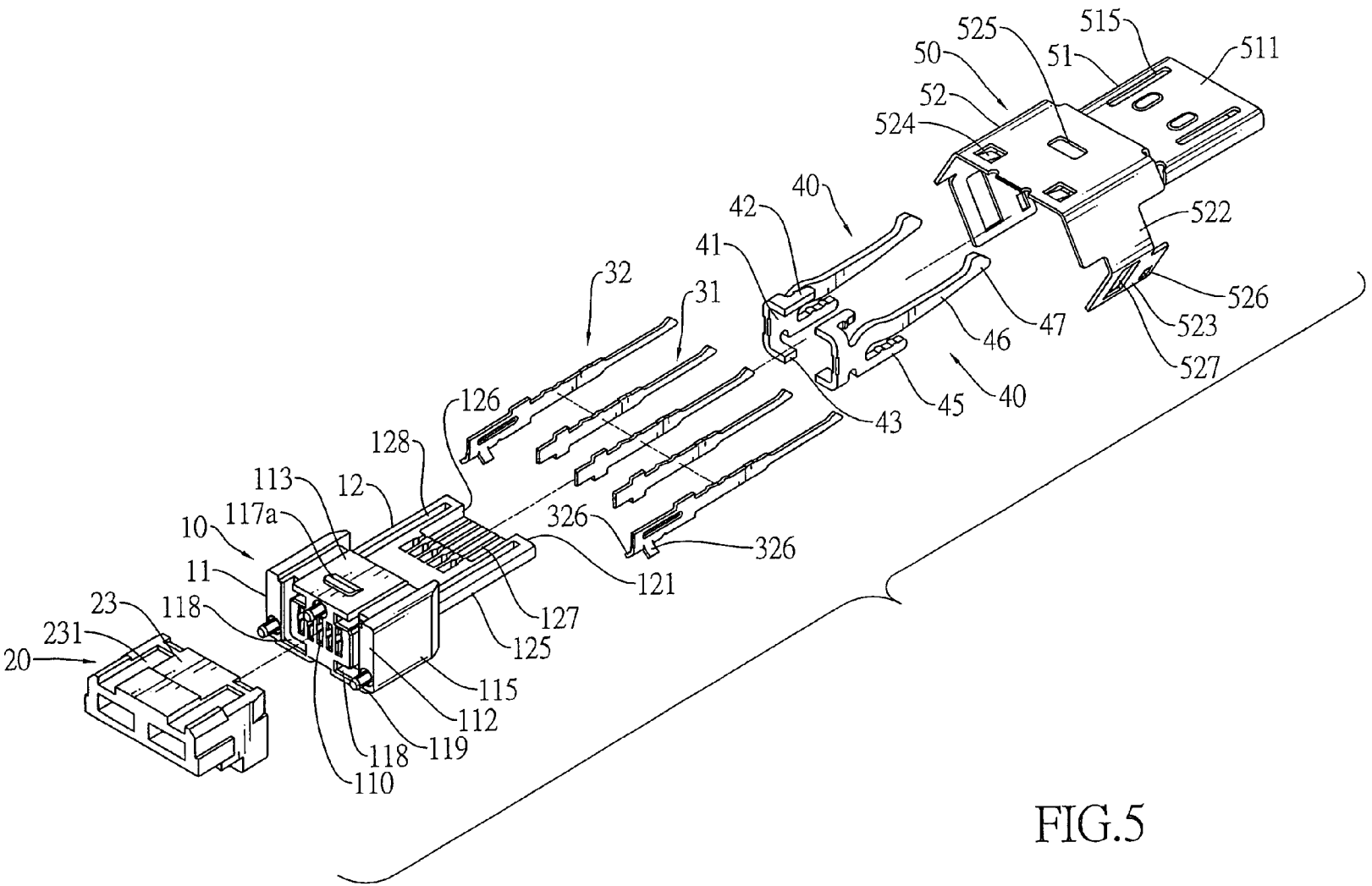
FIG. 5 is an exploded rear perspective view of the micro plug connector in FIG. 4.
Figure 6:
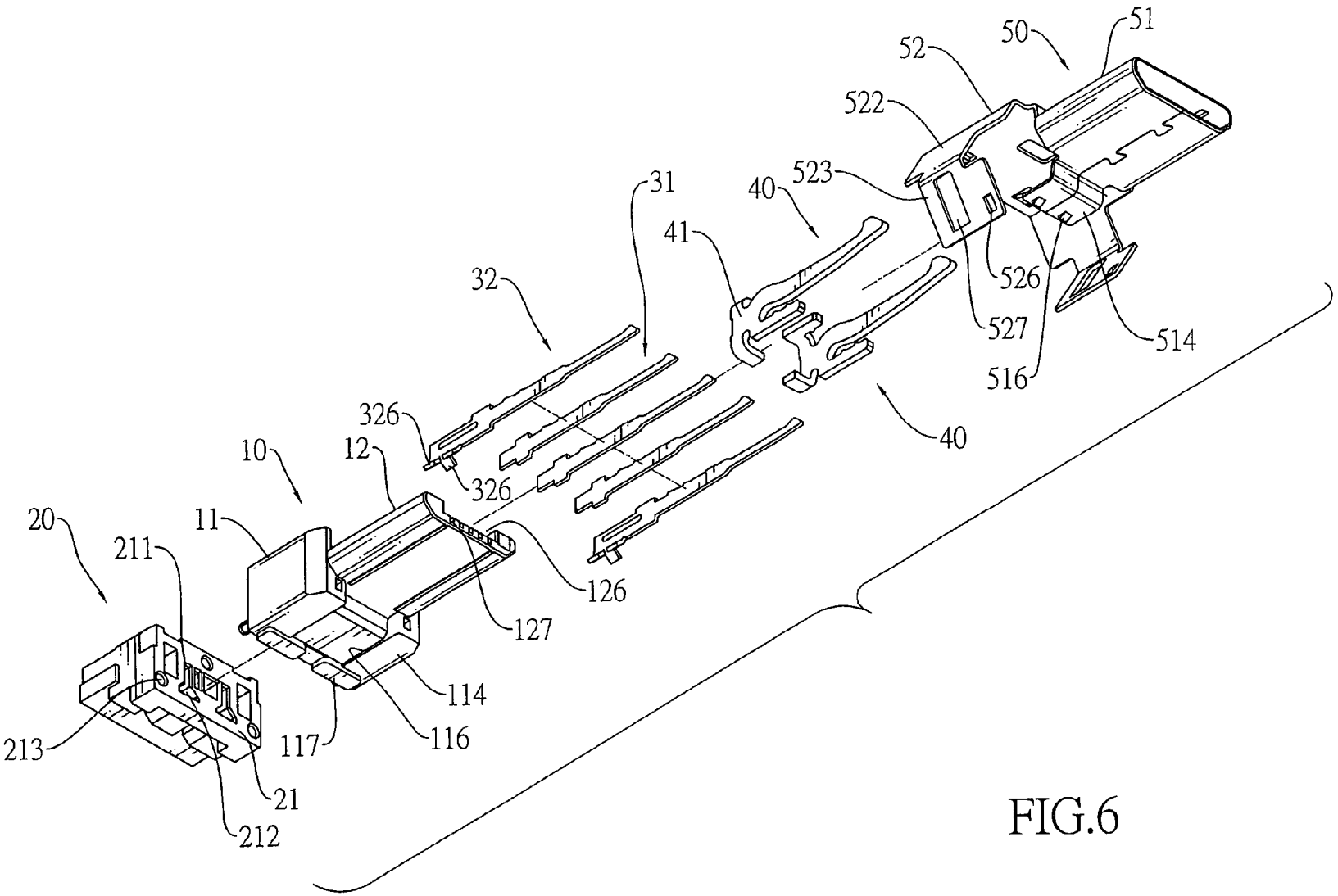
FIG. 6 is an exploded bottom perspective view of the micro plug connector in FIG. 5.

With further reference to FIGS. 5 and 6, the base (11) has a front (111), a rear (112), a top (113), a bottom (114), two opposite sides (115), a plurality of terminal holes (110), two hook holes (118) and a plurality of fastening protrusions (117) and may further have a recess (116), a hooking element (117*a*) and a plurality of positioning posts (119). The terminal holes (110) are defined through the base (11) from the rear (112) to the front (111) and each terminal hole (110) has an inner surface. The hook holes (118) are defined through the base (11) from the rear (112) to the front (111) and are adjacent respectively to the sides (115). Each hook hole (118) may be toppled-U-shaped relative to the base (11) and have an inner surface, an upper transverse passageway, a lower transverse passageway and an upright passageway defined between the upper and lower transverse passageways. The fastening protrusions (117) are formed on and protrude from the bottom (114) adjacent to the rear (112). The recess (116) is defined in the bottom (115). The hooking element (117*a*) is formed on and protrudes from the top (113). The positioning posts (119) are formed on and protrudes from the rear (112).

The tongue (12) is formed on and protrudes from the front (111) of the base (11) and has a front end (121), a top surface (123), a bottom surface, two opposite sides (125), a space (126), a plurality of terminal slots (127) and two hook slots (128). The space (126) is defined in the top surface (123) adjacent to the front end (121), may accommodate a terminal-mount of a socket connector corresponding to the micro plug connector and has an inner bottom surface. The terminal slots (127) are defined in the inner bottom surface of the space (126) and communicate respectively with the terminal holes (110). The hook slots (128) are defined in the top surface (123) respectively adjacent to the sides (125) of the tongue (12) and communicate respectively with the hook holes (118).

The connection bracket (20) is mounted on the rear (112) of the base (11) and has a front end (21), a rear end, a top surface (23) and two opposite sides and may further have a plurality of positioning holes (213), a plurality of terminal channels (211) and a plurality of locking slots (231). The positioning holes (213) are defined in the front end (21) of the connection bracket (20) and are mounted respectively around the positioning posts (119) of the base (11). The terminal channels (211) are defined in the front end (21) of the connection bracket (20). Each of outermost two of the terminal channels (211) has a positioning bore (212) defined in the front end (21) of the connection bracket (20), communicating with the outermost terminal channel (211) and having a triangular cross section. The locking slots (231) are defined in the top surface (23) of the connection bracket (20) and each locking slot (231) has a closed front end and an open rear end. The rear end of the connection bracket (20) may be mounted on a cable so that the micro plug connector is connected to the cable.

Figure 7:
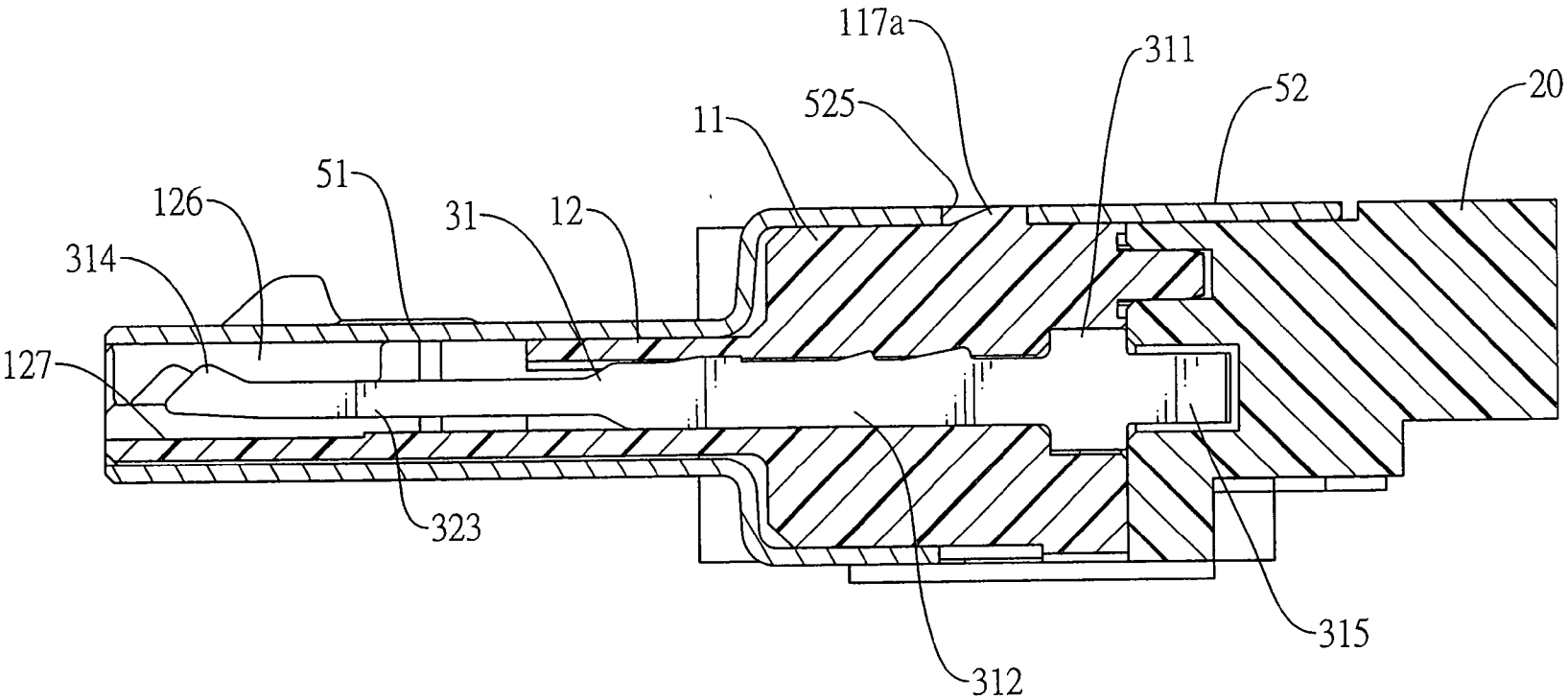
FIG. 7 is a side view in partial section of the micro plug connector in FIG. 1.

With further reference to FIG. 7, the terminals (31, 32) are mounted respectively through the terminal holes (110) of the base, are mounted respectively in the terminal slots (127) of the tongue (12) and are classified into a plurality of first terminals (31) and two second terminals (32). The second terminals (32) are mounted adjacent respectively to the sides (115) of the base (11) to locate the first terminals (31) between the second terminals (32) and are mounted respectively in the outermost terminal channels (211). Each terminal (31, 32) has a connecting portion (315, 325), a root (311, 321), a mounting portion (312, 322), a resilient arm (313, 323) and a contacting portion (314, 324).

The connecting portion (315, 325) is mounted in one of the terminal channels (211) of the connection bracket (20), may be connected to a cable through wires or be connected to printed circuit board by a soldering process and has a thickness.

The root (311, 321) is formed on and protrudes from the connecting portion (315, 325), is mounted in one of the terminal holes (110) adjacent to the rear (112) of the base (11) and has a thickness larger than that of the connecting portion (315, 325).

The mounting portion (312, 322) is formed on and protrudes from the root (311, 321) and is mounted in one of the terminal holes (110) and may have teeth biting the inner surface of the terminal hole (110).

The resilient arm (313, 323) is formed on and protrudes from the mounting portion (312, 322) and is mounted in one of the terminal slots (127).

The contacting portion (314, 324) may be triangular, is formed on and protrudes from the resilient arm (313, 323), is mounted in one of the terminal slots (127) and may electrically contact a terminal of the socket connector corresponding to the micro plug connector.

The second terminals (32) may be charging terminals so that an electronic device including the micro plug connector may be charged through the charging terminals. Each second terminal (32) may further have a plurality of interfering tabs (326). The interfering tabs (326) are formed on and protrude transversely from the connecting portion (325) of the second terminal (32) and are mounted in one of the positioning bore (212) of one of the outermost terminal channels (211) in the connection bracket (20). Adjacent two of the interfering tabs (326) are angled and staggered to extend respectively along two directions.

Figure 8:
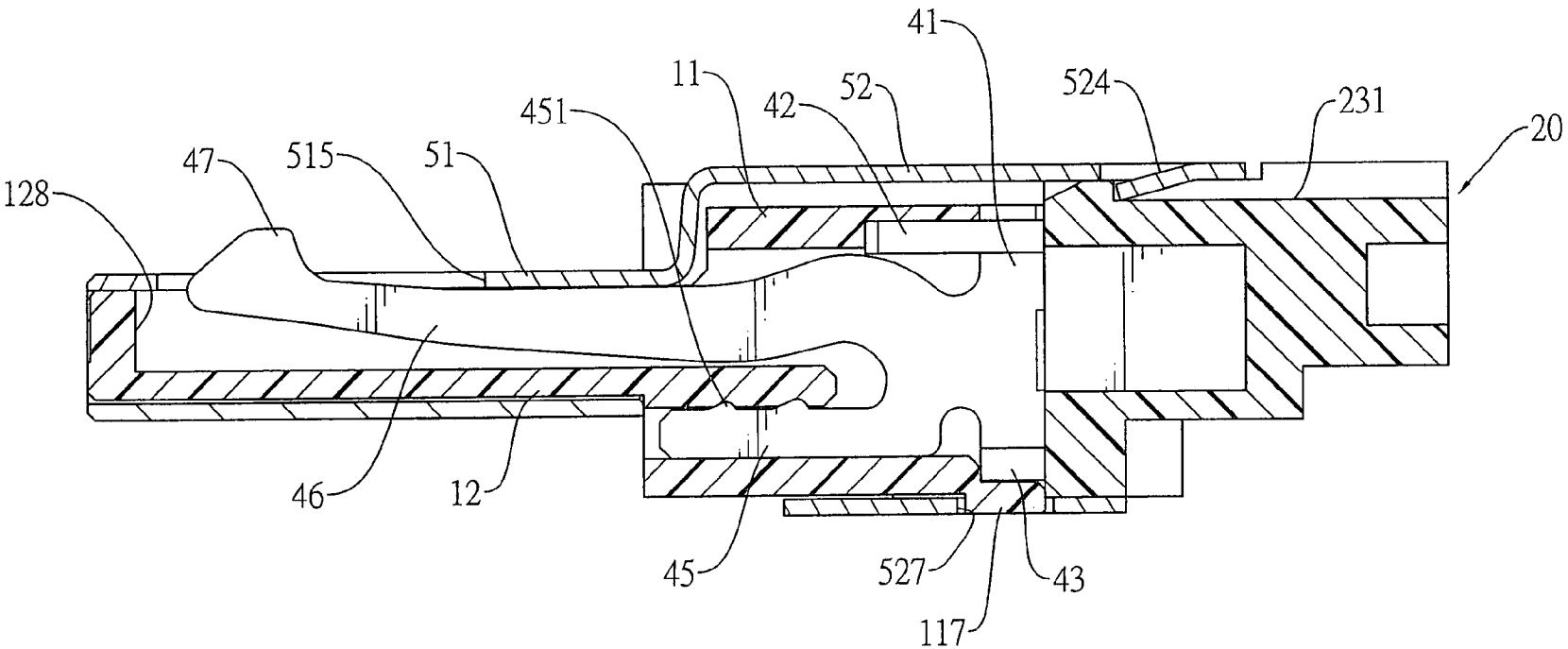
FIG. 8 is another side view in partial section of the micro plug connector in FIG. 1.

With further reference to FIG. 8, the positioning hooks (40) are mounted respectively through and correspond respectively to the hook holes (118) of the base (11), are mounted respectively in the hook slots (128) of the tongue (12) and each positioning hook (40) has a mounting section (41), a resilient section (46) and a hooking member (47) and may further have an extension section (45).

The mounting section (41) is mounted in a corresponding hook hole (118) of the base (11) and may have an upper positioning tab (42) and a lower positioning tab (43). The upper positioning tab (42) is L-shaped, is formed and protrudes transversely from the mounting section (41), is mounted in the upper transverse passageway of the corresponding hook hole (118) and has teeth (421) biting the inner surface of the corresponding hook hole (118). The lower positioning tab (43) is formed on and protrudes transversely from the mounting section (41) and is mounted in the lower transverse passageway of the corresponding hook hole (118).

The resilient section (46) is formed on and protrudes forwards from the mounting section (41) and is mounted in the corresponding hook hole (118) of the base (11).

The hooking member (47) is formed on and protrudes from the resilient section (46) and extends out of the corresponding hook hole (118) of the base (11) to hook detachably on the corresponding socket connector.

The extension section (45) is formed on and protrudes forwards from the mounting section (41) under the resilient section (46), defines an interval between the extension section (45) and the resilient section (46) and has an inside surface and teeth (451). The inside surface faces the resilient section (46). The teeth (451) are formed on the inside surface and biting the inner surface of the corresponding hook hole (118).

Figure 3A:
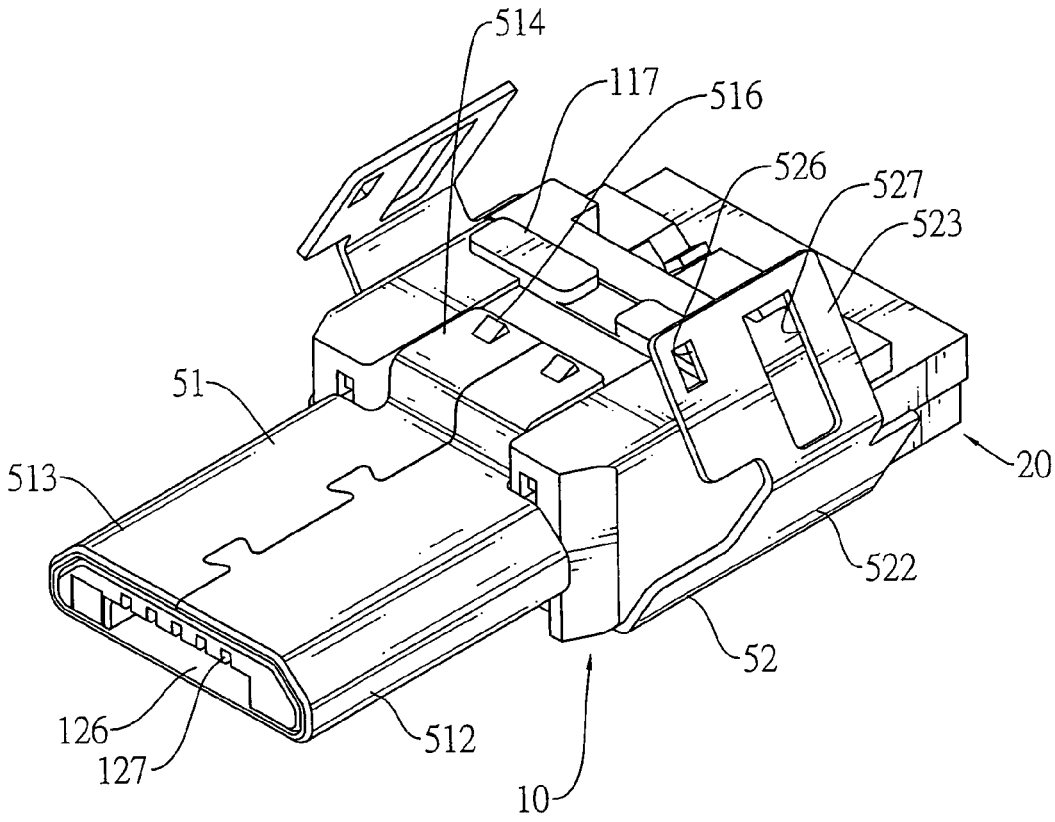
FIG. 3A is a bottom perspective view of the micro plug connector in FIG. 1 showing the micro plug connector is being fabricated halfway.
Figure 3B:
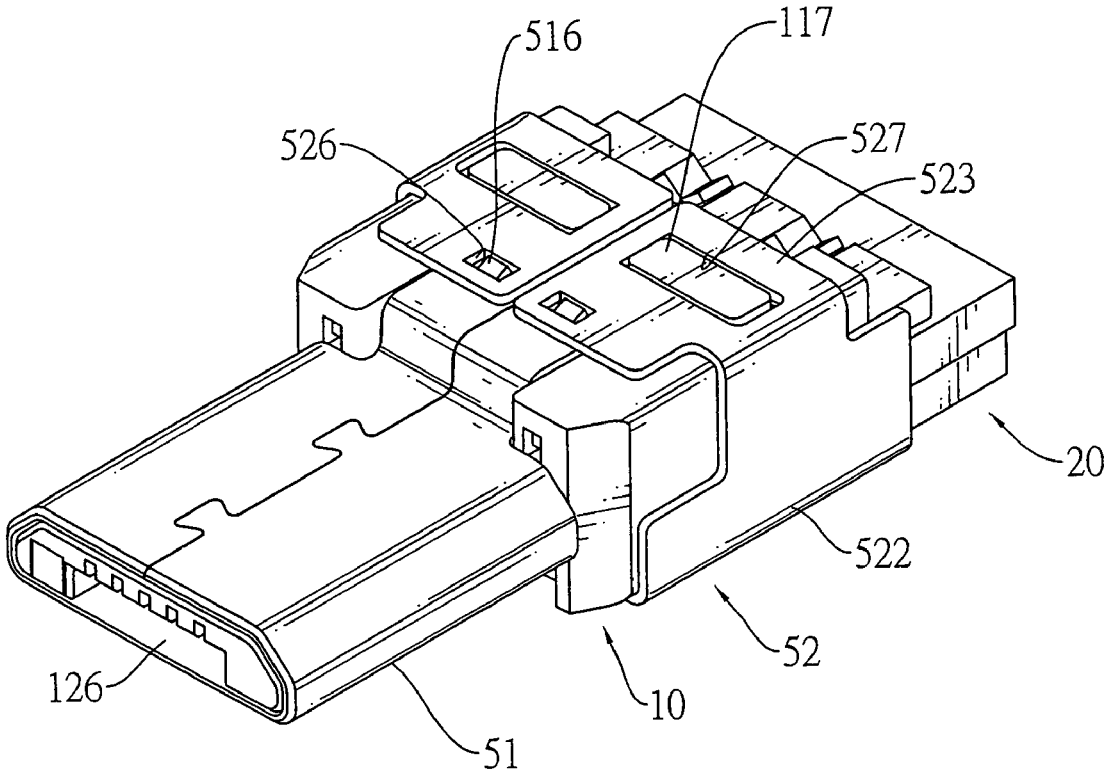
FIG. 3B is a bottom perspective view of the micro plug connector in FIG. 3A showing the micro plug connector is fabricated completely.

With further reference to FIGS. 3A and 3B, the metal shell (50) covers the insulative housing (10) and the connection bracket (20), may be made of a sheet metal by a stamping process and has a front cover (51) and a rear cover (52).

The front cover (51) covers the top surface (123), sides (125) and bottom surface of the tongue (12) and has a top plate (511), two opposite side plates (512), a bottom plate (513), two longitudinal slots (515), a connecting plate (514) and a plurality of first engaging members (516). The top plate has a rear end. The bottom plate (513) has a rear end. The longitudinal slots (515) are defined through the top plate (511) and are mounted respectively around the hooking members (47) of the positioning hooks (40) so that the hooking members (47) extend respectively out of the longitudinal slots (515). The connecting plate (514) is formed on and protrudes backwards from the rear end of the bottom plate (513) and is mounted securely in the recess (116) in the bottom (114) of the base (11) so that the connecting plate (514) partially covers the bottom (114) of the base (11). The recess (116) makes the connecting plate (514) flush with the bottom of the base (10). The first engaging members (516) are defined on the connecting plate (516) and may be protruding tabs formed on and protruding from the connecting plate (516) by a stamping process.

The rear cover (52) is formed and protrudes from the rear end of the top plate (511) of the front cover (51), covers the top (113), sides (115) and bottom (114) of the base (11) and has an upper plate (521), two opposite side plates (522), a lower plate (523), a plurality of second engaging members (526), a plurality of fastening holes (527), a plurality of locking tabs (524) and a hooking opening (525). The side plates (522) of the rear cover (52) are formed on and protrude perpendicularly and respectively from the upper plate (521). The lower plate (523) covers the connecting plate (514) of the front cover (51) and may be defined by two extension plates formed perpendicularly on and protruding inwards from the side plates (522). The second engaging members (526) are defined on the lower plate (523), are engaged respectively with the first engaging members (516) of the front cover (51) and may be openings defined through the lower plate (523) and mounted respectively around the protruding tabs of the front cover (51). The fastening holes (527) are defined through the lower plate (523) and are mounted respectively around the fastening protrusions (117) of the base (11). The locking tabs (524) are formed on and protrude downwards from the upper plate (52), are mounted respectively in the locking slots (231) and abut respectively against the closed front ends of the locking slots (231) to prevent the connection bracket (20) from being disconnected from the insulative housing (10). The hooking opening (525) is defined through the upper plate (521) and is hooked by the hooking element (117*a*) on the base (10).

When the metal shell (50) is assembled to the insulative housing (20), the front cover (1) is mounted around the tongue (12) with the connecting plate (514) mounted in the recess (116) of the base (11). The side plates (52) and extension plates forming the lower plate (523) are not bent to desired positions yet, as shown in FIG. 3A. Then, the side plates (52) and extension plates are bent to around the base (11) and to form the lower plate (523) covering the connecting plate (514) and the bottom (115) of the base (11), as shown in FIG. 3B.

The front cover (51) of the metal shell (50) covers the tongue (12) of the insulative housing (10) with the connecting plate (514) partially covering the base (11). The rear cover (52) further covers and combines the base (12) and connecting plate (514). Therefore, the front and rear covers (51, 52) double cover the insulative housing (10) to strengthen the structures of the micro plug connector. The lap and combination of the front and rear plates (51, 52) also prevents the front and rear plates (51, 52) from inadvertently bending and relative to each other and separating out from the insulative housing (10). Therefore, the micro plug connector mounted on a cable may easily pass through a rotary test without inadvertently failing or separating from the cable.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A micro plug connector comprising:

an insulative housing having a base having a front, a rear, a top, a bottom and two opposite sides and further having a plurality of terminal holes defined through the base from the rear to the front and each terminal hole having an inner surface; and two hook holes defined through the base from the rear to the front; and a tongue formed on and protruding from the front of the base, having a front end, a top surface, a bottom surface and two opposite sides and further having a plurality of terminal slots defined in the top surface and communicating respectively with the terminal holes; and two hook slots defined in the top surface respectively adjacent to the sides of the tongue and communicating respectively with the hook holes;

a plurality of terminals mounted respectively through the terminal holes of the base and mounted respectively in the terminal slots of the tongue;

two positioning hooks mounted respectively through and corresponding respectively to the hook holes of the base, mounted respectively in the hook slots of the tongue and each positioning hook having a mounting section mounted in a corresponding hook hole of the base;

a resilient section formed on and protruding forwards from the mounting section and mounted in the corresponding hook hole; and a hooking member formed on and protruding from the resilient section and extending out of the corresponding hook hole; and a metal shell covering the insulative housing and having a front cover covering the top surface, sides and bottom surface of the tongue, having a top plate, two opposite side plates and a bottom plate and further having two longitudinal slots defined through the top plate and mounted respectively around the hooking members of the positioning hooks;

a connecting plate formed on and protruding backwards from a rear end of the bottom plate and mounted securely in and covering the bottom of the base; and a plurality of first engaging members defined on the connecting plate; and a rear cover formed and protruding from a rear end of the top plate of the front cover, covering the top, sides and bottom of the base, having an upper plate, two opposite side plates and further having a lower plate covering the connecting plate of the front cover; and a plurality of second engaging members defined on the lower plate and engaged respectively with the first engaging members of the front cover.

2. The micro plug connector as claimed in claim 1, wherein the tongue further has a space defined in the top surface adjacent to the front end and having an inner bottom surface; and the terminal slots are defined in the inner bottom surface of the space.

3. The micro plug connector as claimed in claim 2, wherein each terminal has a connecting portion mounted in one of the terminal channels of the connection bracket;

a root formed on and protruding from the connecting portion and mounted in one of the terminal holes adjacent to the rear of the base;

a mounting portion formed on and protruding from the root and mounted in one of the terminal holes;

a resilient arm formed on and protruding from the mounting portion and mounted in one of the terminal slots; and a contacting portion formed on and protruding from the resilient arm and mounted in one of the terminal slots.

4. The micro plug connector as claimed in claim 3, wherein the terminals are classified into a plurality of first terminals and two second terminals, the second terminals are mounted adjacent respectively the sides of the base to locate the first terminals between the second terminals.

5. The micro plug connector as claimed in claim 4, wherein the first engaging members are protruding tabs formed on and protruding from the connecting plate of the front cover; and the second engaging members are openings defined through the lower plate of the rear cover and mounted respectively around the protruding tabs.

6. The micro plug connector as claimed in claim 5, wherein the base further has a plurality of fastening protrusions formed on and protruding from the bottom; and the rear cover of the metal shell further has a plurality of fastening holes defined through the lower plate and mounted respectively around the fastening protrusions of the base.

7. The micro plug connector as claimed in claim 6, wherein the base further has a plurality of fastening posts formed on and protruding from the rear;

a connection bracket is mounted on the rear of the base and has a front end, a rear end, a top surface and two opposite sides and further has a plurality of positioning holes defined in the rear end and mounted respectively around the positioning posts;

a plurality of terminal channels defined in the front end of the connection bracket and each of outermost two of the terminal channels having a positioning bore defined in the front end of the connection bracket, communicating with the outermost terminal channel and having a triangular cross section;

each of the first and second terminals is mounted in one of the terminal channels and the second terminals are mounted respectively in the outermost terminals channels and each second terminal has a plurality of interfering tabs formed on and protruding transversely from the connection portion of the second terminal and mounted in one of the positioning bore of one of the outermost terminal channels and adjacent two of the interfering tabs being angled and staggered to extend respectively along two directions.

8. The micro plug connector as claimed in claim 7, wherein:

the connection bracket further having a plurality of locking slots defined in the top surface of the connection bracket and each locking slot having a close front end and an open rear end; and the rear cover of the metal shell further having a plurality of locking tabs formed on and protruding downwards from the upper plate and mounted respectively in the locking slots and abutting respectively against the closed front ends of the locking slots.

9. The micro plug connector as claimed in claim 8, wherein the base further has a hooking element formed on and protruding from the top; and the rear cover further having a hooking opening defined through the upper plate and hooked by the hooking element on the base.

10. The micro plug connector as claimed in claim 9, wherein each hook hole of the base is toppled-U-shaped relative to the base and has an inner surface, an upper transverse passageway, a lower transverse passageway and an upright passageway between the upper and lower transverse passageways; and the mounting section of each hook has an upper positioning tab being L-shaped, formed and protruding transversely from the mounting section, mounted in the upper transverse passageway of the corresponding hook hole and having teeth biting the inner surface of the corresponding hook hole; and a lower positioning tab formed on and protruding transversely from the mounting section and mounted in the lower transverse passageway of the corresponding hook hole.

11. The micro plug connector as claimed in claim 10, wherein each positioning hook further have an extension section formed on and protruding forwards from the mounting section under the resilient section, defining an interval between the extension section and the resilient section and having an inside surface facing the resilient section; and teeth formed on the inside surface and biting the inner surface of the corresponding hook hole of the base.

12. The micro plug connector as claimed in claim 11, wherein the base further has a recess defined in the bottom; and the connecting plate of the front cover of the metal shell is mounted securely in the recess and is flush with the bottom of the base.

13. The micro plug connector as claimed in claim 12, wherein the micro plug connector complies with the Micro Universal Serial Bus standard.

* * * * *